US005572771A

United States Patent [19]

Kelleghan

[11] Patent Number: 5,572,771

[45] Date of Patent: Nov. 12, 1996

[54] STRAP BUCKLE

[76] Inventor: Brian J. Kelleghan, 608 W. 9th Ave., Longmont, Colo. 80501

[21] Appl. No.: 343,234

[22] Filed: Nov. 22, 1994

[51] Int. Cl.[6] ..... A44B 11/12

[52] U.S. Cl. ..... 24/170; 24/191

[58] Field of Search ..... 24/170, 191, 134 R, 24/168

[56] References Cited

U.S. PATENT DOCUMENTS

| | | | |
|---|---|---|---|
| 2,998,626 | 9/1961 | Prete, Jr. . | |
| 3,328,856 | 7/1967 | Jonas . | |
| 3,339,248 | 9/1967 | Campaiola . | |
| 3,823,444 | 7/1974 | Takabayashi | 24/191 |
| 4,300,269 | 11/1981 | Boden | 24/134 R |
| 4,373,234 | 2/1983 | Boden | 24/191 |
| 4,843,688 | 7/1989 | Ikeda . | |
| 5,469,583 | 11/1995 | Akeley et al. | 24/191 X |

*Primary Examiner*—James R. Brittain
*Attorney, Agent, or Firm*—Francis A. Sirr; Earl C. Hancock; Holland & Hart llp

[57] ABSTRACT

In a buckle, the loose end of a belt is clamped by operation of a pivoted lever that is pressed down onto a base member, a lever belt gripping surface engages one surface of the belt and forces the opposite surface onto a resilient surface in the base member. Flexing of this resilient surface provides a force that secures the belt between the resilient surface and the belt gripping surface. The lever is mounted to the base member by a pair of internal, tapered pins. A pair of flexible mating tapered tabs on the lever mount the lever on the pins. Mating tapers lead or guide the pins to the location of lever holes, thus allowing the lever to be mounted on the base member. In another embodiment, one rigid tab and one flexible tapered tab are located on the lever for mounting the lever on the two pins. This one flexible tab leads or guides a mating pin to a lever hole, thus allowing the lever to be mounted on the base member. Mating snap means are provided to snap latch the lever to the base member. The exterior shape of the base member and lever provide a smooth, continuous, outline when the lever is in its closed position, thus minimizing accidental opening of the buckle.

5 Claims, 2 Drawing Sheets

STRAP BUCKLE

BACKGROUND OF THE INVENTION

1. Field of the invention

This invention relates to the field of buckles, and more specifically to a belt buckle wherein the loose end of a belt or strap is clamped to the buckle by manual operation of a pivoted lever.

2. Description of the Related Art

The art provides a variety of buckles of a configuration wherein a pivoted lever operates to trap the loose end of a belt or strap. For example, in U.S. Pat. No. 2,998,626 a strap buckle includes a spring biased release arm that includes a serrated eccentric gripping surface. While a strap end may be pulled past this gripping surface, a force on the strap in the opposite direction tends to rotate the gripping member against a stationary transverse bar, thus trapping the strap end between the gripping surface and the transverse bar.

In U.S. Pat. No. 3,328,856, a two piece adjustable buckle includes a frame member and a locking member, both of which are fabricated of a plastic material. The frame member includes at one end a transversely extending, circular cross section bar upon which one end of the locking member is pivotally mounted by virtue of the flexing of a mating elongated groove that is carried at one end of the locking member. The frame member also carries a parallel extending intermediate bar of a rectangular cross section. As the locking member is closed, a strap is trapped within an elongated cavity that is carried by the locking member, as this cavity receives the frame's intermediate bar.

U.S. Pat. No. 3,339,248 describes a watch band clasp wherein a pivoted clip plate depresses a pressure plate down unto a base member, to thereby trap an end of the watch band between the pressure plate and the base member when the clip plate is rotated to its closed position.

U.S. Pat. No. 4,843,688 describes a belt buckle wherein a pivoted belt gripping member is mounted to a base member by way of the cooperation of pivot pins that mate with bearing holes and guide grooves that lead to the bearing holes. When the gripping member is pivoted down onto the base member, a nonslip surface carried by the gripping member forces a belt end against a shaft that is carried by the base member.

While the art as generally represented above was satisfactory for its limited intended purposes, the need remains in the art for a buckle of simple construction having an improved means for pivotally mounting a clasp member onto a base member in an essentially nonreleasable manner, wherein a means is provided to produce snap latching of the clasp to the base member, and wherein securing a belt end is facilitated by the flexing of a surface of the base member as the clasp is pressed into its latched position, to thus securely hold the belt end.

SUMMARY OF THE INVENTION

The present invention provides a buckle wherein the loose end of a belt or strap is clamped to the buckle's base member by manual operation of a pivoted lever or clasp.

The buckle of this invention is of simple two-piece construction having an improved means for pivotally mounting a clasp member onto the base member, having means providing snap latching of the clasp to the base member, having means to secure a belt end by the flexing or deformation of a surface of the base member as the clasp member is pressed down into its latched position, and having smooth and continuous exterior surface outline when the lever is in its closed position.

While not critical to the spirit and scope of the invention, in a preferred embodiment of the invention, both the base member and the clasp member were made of a plastic material, for example the base member and the lever may be formed of the brand Delrin acetal resin or the brand Nylon polyamide polymer.

An object of this invention is to provide a buckle wherein the loose end of a strap or belt is clamped to a base member by manual operation of a pivoted lever. As the lever is pivoted down onto a base member, a belt gripping surface engages one wide surface of the belt, and forces the opposite wide surface of the belt down onto a resilient surface that is formed in the base member. Flexing of this resilient surface as the lever is lowered provides a force that secures the belt between the base member's resilient surface and the lever's belt gripping surface.

As a feature of the invention, the pivoted lever is mounted to the base member by way of a pair of internal tapered pins that are located on the base member, and by way of mating tapered tabs or surfaces that are located on the lever. These two mating tapers or inclined surfaces lead or guide lever holes location of the mating base member pins, thus allowing the lever to be easily mounted on the base member in a manner that greatly restricts subsequent removal of the lever from the base member.

While not critical to the spirit and scope of the invention, in a preferred embodiment thereof the above mentioned pins were carried by the base member and the above mentioned holes were carried by the lever. Thus, in an equivalent structure, the holes may be carried by the base member and the pins may be carried by the lever.

As a further feature of the invention, mating snap means are provided to produce snap latching of the lever to the base member, thus minimizing accidental opening.

As yet a further feature of the invention, the mating shapes of the base member and the lever provide a smooth, continuous exterior surface for the buckle when the lever is in its closed position, thus additionally minimizing accidental opening of the buckle or the hyper-extended closing of the buckle.

These and other objects, advantages and features of the invention will be apparent to those of skill in the art upon reference to the following detailed description of the invention, which description makes reference to the drawing.

DETAILED DESCRIPTION OF THE INVENTION

Figure 1:
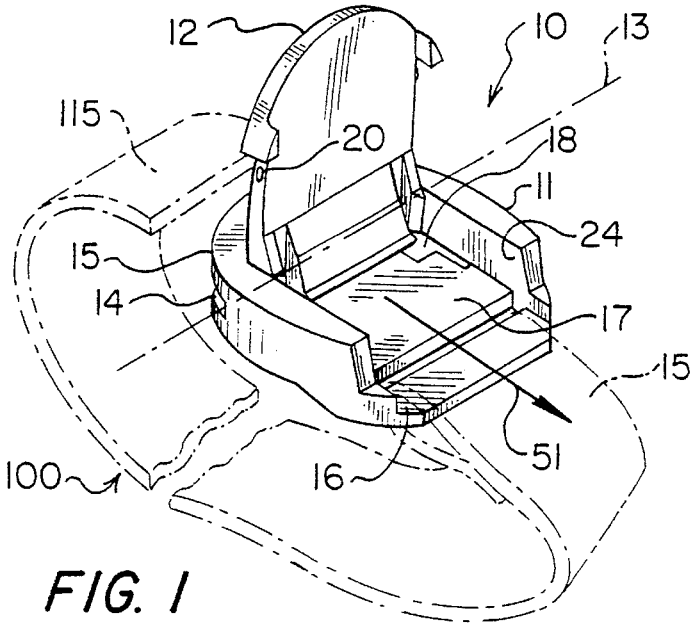
FIG. 1 is a top and left side perspective view of a buckle in accordance with the invention, showing the buckle's pivoted latch member in its upper, unlatched, or open position, showing in dotted lines the right hand end of a belt secured to the buckle's base member, and showing the left hand end of the belt in a position where it is ready to be inserted into the open buckle.
Figure 2:
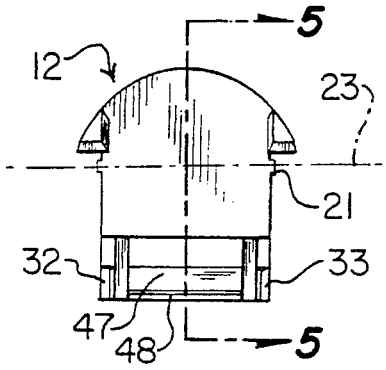
FIG. 2 is a bottom view of the latch member of FIG. 1.
Figure 3:
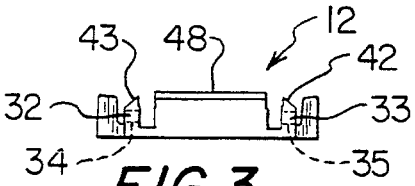
FIG. 3 bottom view of the latch member of FIG. 2

FIG. 1 is a top and left side perspective view of a buckle 10 in accordance with this invention. FIG. 1 shows the buckle's pivoted latch member or latch lever 12 in its upper, unlatched, or buckle-open position. This figure also shows the right hand end 15 of a belt 100 secured, as by sewing and the like, to a bar 16 that is carried by the buckle's base member 11, and shows the left hand end 115 of belt 100 in a position where end 115 is ready to be inserted (i.e., moved to the right) into open buckle 10 and into a slot 14 that is formed in the left hand arcuate wall 15 of base member 11. As will be apparent, lever 12 is manually pivoted in a FIG. 1 clockwise direction, about pivot axis 13, in order to place lever 12 in its lowered or belt closed position, which position is shown in FIG. 9.

This invention provides a buckle 10 wherein the loose end 115 of belt 100 is clamped to the buckle's base member 11 by manual operation of pivoted lever 12. Buckle 10 is of simple two-piece construction 11,12 and provides an improved structural means for pivotally mounting lever or clasp member 12 onto base member 11, to be described. Lever 12 includes projecting tabs or bosses 20,21 that are located on a common axis 23. Tabs 20,21 provide an interference fit to internal and parallel surfaces 24,25 of base member 11, thus providing snap latching of lever 12 to base member 11 when lever 12 is moved to its FIG. 9 closed position.

Figure 6:
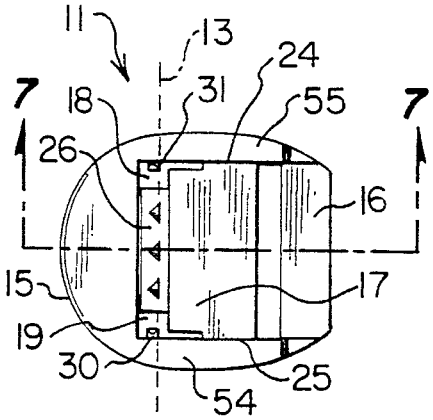
FIG. 6 is a top view of the base member of FIG. 1 with the latch member removed from the base member.
Figure 4:
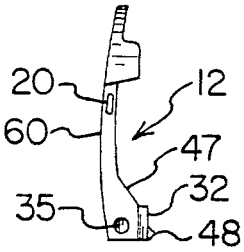
FIG. 4 is a left side view of the latch member of FIG. 2.
Figure 5:
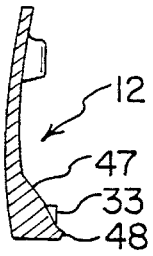
FIG. 5 is a left side section view of the latch member of FIG. 2 taken on the line 5—5 of FIG. 2.
Figure 7:
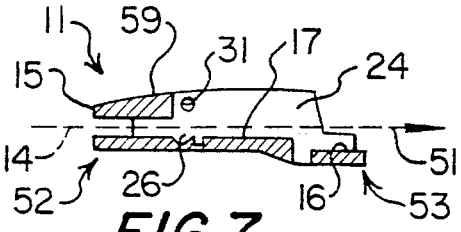
FIG. 7 is a bottom side section view of the base member of FIG. 6 taken on the line 7—7 of FIG. 6.
Figure 8:
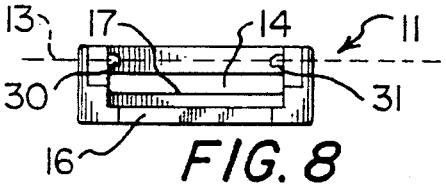
FIG. 8 is a right side view of the base member of FIG. 6.
Figure 11:
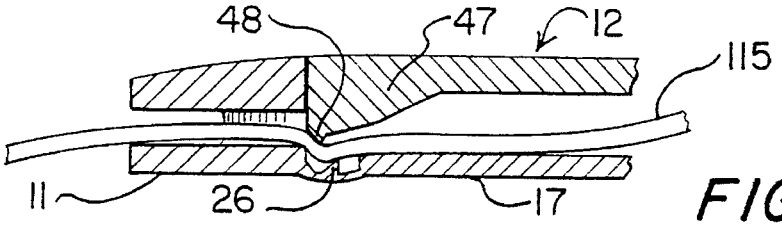
FIG. 11 is a left side partial section view of the latch member and base member of FIG. 1, this figure showing how the loose end of the belt is clamped to the base member by manual CW rotation of the latch member as the latch member is pivoted from its FIG. 1 position to its FIG. 9 position, this operation of the latch member operating to flex a flexible floor portion of the base member as a relatively wide belt gripping member engages the upper surface of the belt and forces the opposite surface of the belt down onto this flexible floor portion, flexing of this resilient floor portion providing a belt trapping force that secures the belt within the buckle.

With reference particularly to FIGS. 6, 7 and 11, base member 11 includes a relatively thin and resilient lower wall surface 17 that includes a pair of generally L-shaped cut-away portions 18 and 19 and a row of upward projecting tabs or serrations 26 that extend generally parallel to pivot axis 13. As will be apparent, wall surface 17 comprises means to secure belt end 115 to buckle 10 by the downward flexing or deformation of surface 17 as clasp lever 12 is pressed down into its FIG. 9 latched or closed position.

Figure 9:
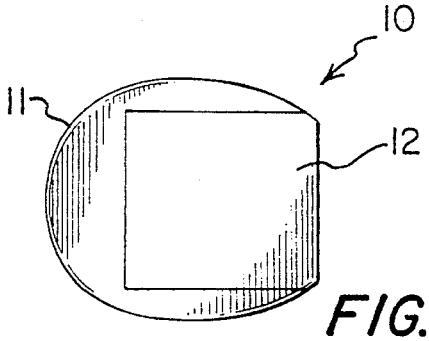
FIG. 9 is a top view of the buckle of FIG. 1 showing the latch member in its lower or closed position, the belt of FIG. 1 not being shown in FIG. 9.

FIG. 9 shows a feature of the invention whereby buckle 10 in its closed position presents a smooth and continuous exterior surface outline, thus minimizing the likelihood that buckle 10 will be accidentally opened to its FIG. 1 position.

An important feature of the invention mounts pivoted lever 12 to base member 11 by way of a pair of internally located and tapered pins 30 and 31 that lie on axis 13 and project generally perpendicular outward from generally parallel wall surfaces 24 and 25 of base member 11, and by way of mating tapered and flexible tabs 32 and 33 that are located on lever 12, the mating tapers on tabs 32,33 and pins 30,31 leading or guiding lever 12 to the location of tab holes 34 and 35 that mate with pins 30,31. This unique structural arrangement allows lever 12 to be easily mounted on pins 30,31 of base member 11, to pivot about axis 13. This mounting arrangement greatly restricting subsequent removal of lever 12.

Figure 10:
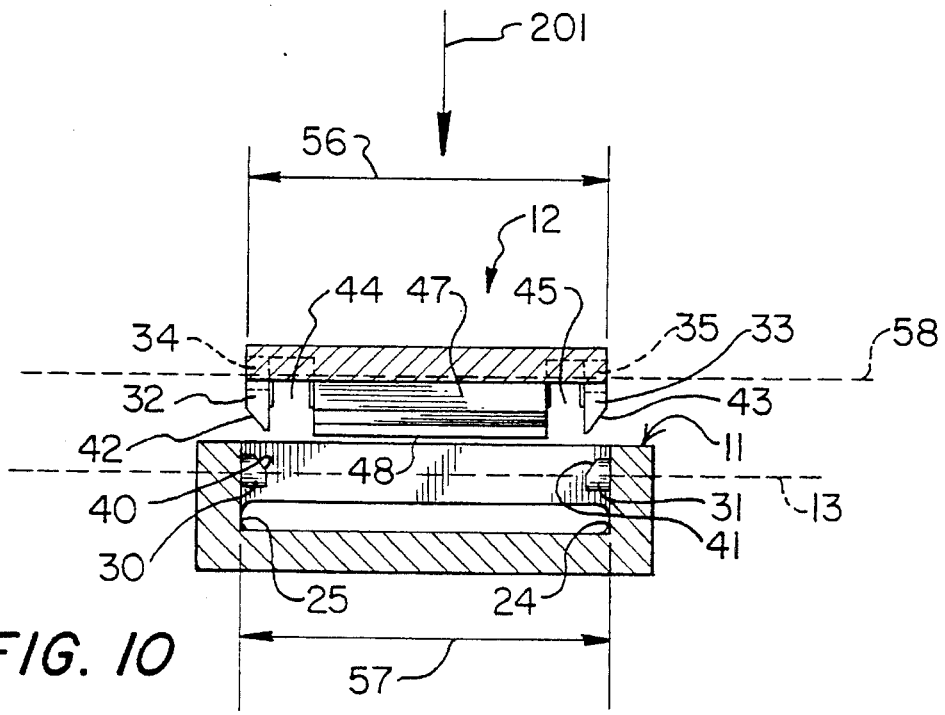
FIG. 10 is a cutaway portion of the latch member in elevated position relative to a cutaway portion of the base member, this being a manufacturing position just prior to mounting the latch member onto the base member by pushing the latch member in a linear direction down onto the base member, which mounted position is shown in FIGS. 1 and 9.

FIG. 10 shows an enlarged cutaway portion of lever 12 in an elevated position relative to an enlarged cutaway portion of base member 11. As can be seen from this figure, tapered pins 30,31 each include an upward facing inclined surface 40,41. Tabs 32,33 of lever 12 include mating downward facing inclined surfaces 42,43. Lever 12 is also provided with two gaps, relief areas or spaces 44,45 that allow tabs 32,33 to flex inward as lever 12 is pressed vertically down in the direction 201 onto base member 11 during manufacture of buckle 10. As tabs 32,33 flex inward, due to the force of engagement of surfaces 40,42 and surfaces 41,43, tabs 32,33 and lever 12 lower to a level whereat base member pins 30,31 enter tab holes 34,35. Once this position is reached, lever 12 is pivotally mounted to base member 11 for manual movement about axis 13. Due to the construction and arrangement whereby tabs 32,33 are now buried within buckle 10, is it very difficult for lever 12 to subsequently become disengaged from base member 11, either accidentally or intentionally.

In buckle 10, the loose end 115 of strap or belt 100 is clamped to base member 11 by manual operation of pivoted lever 12, as lever 12 is pivoted CW from its FIG. 1 position to its FIG. 9 position. With reference to FIG. 11, as lever 12 is pivoted down, the lever's surface 48 and/or relatively wide belt gripping member 47 (also see FIGS. 2–5) engages the upper wide surface of belt 100, and forces the opposite wide surface of belt 100 down onto the resilient surface 17 that is formed in base member 11. Downward flexing of resilient surface 17 (exaggerated in FIG. 11), as lever 12 is moved CW and lowered to its FIG. 9 position, provides a belt trapping force that secures belt 100 between the base member's resilient surface 17 and the lever's belt gripping surface 47,48.

From the above description it can be seen that an improved belt and buckle combination has been provided wherein belt 100 having a width 50, a free end 115, and an opposite end 15 is associated with a buckle base member 11 having an upward facing floor 17, floor 17 defining a belt insertion axis 51 along which the free end 115 of belt 100 is movable from a first end 52 of floor 17 to a second end 53 of floor 17. A means 16 secures the opposite end 15 of belt 100 to the second end 53 of floor 17. First and second spaced walls 54,55 extending vertically upward from floor 17, walls 54,55 being spaced apart a distance measured perpendicular to insertion axis 51 that is generally equal to the width 50 of belt 100. Walls 54,55 include facing wall surfaces 24,25 that extend vertically upward generally perpendicular to floor 17 and generally parallel to insertion axis 51. A first and second inward facing pivot post 30,31 extending a short distance generally perpendicular from walls 54,55. Pivot posts 30,31 are spaced upward from floor 17 and are located on a common pivot axis 13, each of the pivot posts having a terminal end that includes an upwardly inclined generally flat surface 40,41.

A buckle closing lever 12 has a width 56, measured along pivot axis 13, that is generally equal to the spacing 57 of walls 24,25. A first and a second inward flexible pivot tab 32,33 extends downward from lever 12 in general vertical alignment with pivot posts 30,31. The terminal end of each of pivot tab 32,33 has a terminal end that includes a downward facing inclined surface 42,43 that is in alignment with the upward facing inclined surfaces 40,41 on the terminal ends of pivot posts 30,31. Pivot holes 34,35 in pivot tabs 32,33 are located on a common axis 58, each of the pivot holes 34,35 being shaped to receive a pivot post 30,31.

Downward movement 201 of lever 12 from its FIG. 10 position, to thereby mount lever 12 on base member 11, causes pivot tabs 32,33 to temporarily flex inward as upward inclined surfaces 40,41 and downward inclined surfaces 42,43 physically engage, thereby bringing holes 34,35 into alignment with pivot posts 30,31.

As a feature of the invention, a flexible portion of floor 17 is provided at a location that is intermediate the ends 52,53 of floor 17. Buckle closing lever 12 is pivotally mounted to walls 24,25 at a location generally overlying this flexible floor portion. A belt engaging surface 47,48 is carried by lever 12, surface 47,48 being spaced from this flexible floor portion when lever 12 is in the buckle open position of FIG. 1, to thereby enable movement of the free end 115 of belt 100 along insertion axis 51. Belt engaging surface 47,48 is brought generally into engagement with this flexible floor portion when lever 12 is in its buckle closed position shown in FIG. 9. In this way, belt 100 is forced down onto the flexible floor portion, as shown in FIG. 11, and flexing of this flexible floor portion occurs when lever 12 is in its buckle closed position.

As seen in FIG. 7, for example, a generally flat housing member 59 overhangs and extends generally parallel to floor 17. Housing member 59 is mounted to walls 24,25 in a manner to overlying the first end 52 of floor 17, as housing member forms a first portion of a generally flat upper external surface of buckle 10. Housing member 59 and floor 17 defining a slot 14 therebetween for movement of the free end 115 of belt 100 along insertion axis 51.

Lever 12 includes an upper flat housing surface 60 thereon, generally opposite to belt engaging surface 47,48, this housing surface 60 forming a second portion of the flat upper external surface of buckle 10 when lever 12 is in the buckle closed position of FIG. 9.

Figure 12:
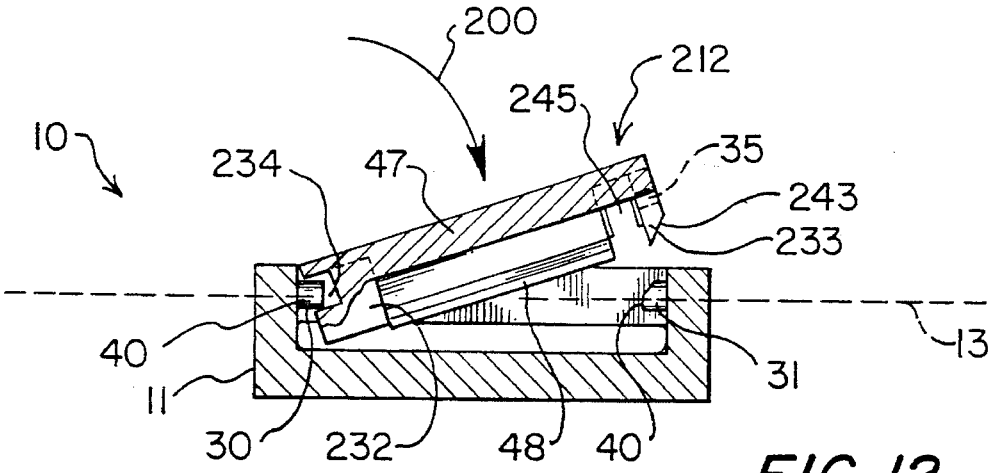
FIG. 12 is a shows a second embodiment of the invention wherein a cutaway portion of a modified latch member is tilted in an elevated position relative to a cutaway portion of the base member, this being a manufacturing position just prior to mounting the modified latch member onto the base member by rotational movement of the latch member, which mounted position is shown similar to that shown in FIGS. 1 and 9.

FIG. 12 shows a second embodiment of the invention wherein a cutaway portion of a modified latch member or lever 212 is tilted in an elevated manufacturing position relative to a cutaway portion of base member 11, this being a manufacturing position just prior to mounting modified latch member 212 onto base member 11 by rotational movement of latch member 212, as is indicated by arrow 200, which mounted position is similar to that shown in FIGS. 1 and 9.

As can be seen from FIG. 12, only pivot pin 31 need be tapered at surface 41. Tabs or mounting surfaces 232,233 of lever 212 include only one mating downward facing inclined surface 243. Lever 212 is also provided with one gap, relief area or space 245 that allows tab 233 to flex inward as lever 212 is rotated down (CW in FIG. 12) onto base member 11 during manufacture of buckle 10. As tab 233 flexes inward, due to the force of engagement of surface 243 and surface 41, tab 233 and lever 212 lower to a level whereat base member pins 30,31 enter tab holes 234,35. Once this position is reached, lever 212 is pivotally mounted to base member 11 for manual movement about axis 13. Due to the construction and arrangement whereby surfaces 232,233 are now buried within buckle 10, is it very difficult for lever 212 to subsequently become disengaged from base member 11, either accidentally or intentionally.

The invention has been described in detail while making reference to various features and embodiments thereof. However, it is apparent that those of skill in the art will readily visualize yet other features and embodiments of the invention that are within the spirit and scope of the invention. Thus, it is not intended that the forgoing description be taken as a limitation on the invention.

What is claimed is:

1. A buckle for releasably fastening the end of a flat and relatively wide web, said web having a width, a thickness, a first wide surface, and an second oppositely disposed wide surface that is generally parallel to said first wide surface, said buckle comprising;

a base member having a flexible surface adapted to receive the first surface of the web, said flexible surface defining an end insertion axis, a pair of inward facing and spaced pivot posts formed as a portion of said base member, said pivot posts being located on a common pivot axis that extends generally normal to said insertion axis and overhangs said flexible surface by a distance somewhat greater than the thickness of the web, each of said pivot posts having a terminal end, an upward facing tapered surface formed on said terminal end of each of said pivot posts, a buckle closing lever pivotally attached to said pivot posts by way of a pair of flexible tabs each having a pivot hole receiving one of said pivot posts, said flexible tabs each having a downward facing tapered surface that mates with said upward facing tapered surfaces of said pivot posts during attachment of said lever to said base member, said lever being positioned generally above said flexible surface, said lever being movable between a buckle-closed position and a buckle-open position, and a relatively wide web engaging surface carried by said lever, said web engaging surface being spaced from said flexible surface when said lever is in said buckle open-position, and said web engaging surface being located closely adjacent to said flexible surface when said lever is in said buckle-closed position, movement of said lever from said buckle-open position to said buckle closed position operating to trap the web between said flexible surface and said web engaging surface.

2. The buckle of claim 1 including;

snap latching means associated with said base member and said lever and operable to releasably latch said lever in said buckle-closed position.

3. The buckle of claim 2 wherein said base member and lever are formed of an acetal resin and/or a polyamide polymer.

4. A belt and buckle combination, comprising, a belt having a width, a thickness, a free end, and an opposite end, a buckle base member having a flexible surface at one end of said buckle base member, said flexible surface defining a belt insertion axis for receiving said free end of said belt, means attaching said opposite end of said belt to an end of said buckle base member that is spaced from said flexible surface along said insertion axis, a pair of inward facing and spaced pivot posts formed as a portion of said buckle base member, said pair of pivot posts being located on a common pivot axis that extends generally normal to said insertion axis and overhangs said flexible surface by a distance somewhat greater than said thickness of said belt, each of said pivot posts having a terminal end, a buckle closing lever pivotally attached to said pair of pivot posts by way of a pair of tabs, each of said tabs having a pivot hole receiving one of said pivot posts, said buckle lever being positioned generally above said flexible surface, said buckle lever being movable between a buckle-closed position and a buckle-open position, a relatively wide belt engaging surface carried by said buckle lever, said belt engaging surface being spaced from said flexible surface when said buckle lever is in said buckle open-position, and said belt engaging surface being located closely adjacent to said flexible surface when said buckle lever is in said buckle-closed position, movement of said buckle lever from said buckle-open position to said buckle-closed position operating to trap said belt between said flexible surface and said web engaging surface, and snap latching means associated with said buckle base member and said buckle lever and operable to releasably latch said buckle lever in said buckle-closed position.

5. The belt and buckle combination of claim 4 wherein;

at least one of said tabs on said buckle lever includes a downward facing tapered surface that engages said terminal end of at least one of said pivot posts during attachment of said buckle lever to said buckle base member.

* * * * *